United States Patent [19]

Ross

[11] Patent Number: 4,680,677

[45] Date of Patent: Jul. 14, 1987

[54] FREESTANDING LUMINAIRE HAVING FLOOR-SUPPORTED FRAME INTEGRATED WITH LIGHT FIXTURE

[76] Inventor: John J. Ross, 328 D. Babcock Blvd., Gibsonia, Pa. 15044

[21] Appl. No.: 713,221

[22] Filed: Mar. 18, 1985

[51] Int. Cl.[4] ..... F21V 13/00

[52] U.S. Cl. ..... 362/33; 362/224; 362/236; 362/250; 362/311; 362/431

[58] Field of Search ..... 362/33, 127, 134, 153, 362/217, 223, 225, 227, 233, 235, 236, 249, 250, 311, 257, 382, 388, 410, 413, 414, 418, 422, 424, 431, 362, 367, 224

[56] References Cited

U.S. PATENT DOCUMENTS

| | | | |
|---|---|---|---|
| 2,553,094 | 5/1951 | Jarrett et al. . | |
| 2,732,487 | 1/1956 | Crider | 362/410 |
| 2,850,622 | 9/1958 | Johnson | 362/275 |
| 3,240,928 | 3/1966 | Young | 362/225 |
| 3,341,702 | 9/1967 | Neumann . | |
| 3,356,841 | 12/1967 | Horan . | |
| 3,535,509 | 10/1970 | Thornton . | |
| 3,997,776 | 12/1976 | Ruud | 362/127 |
| 4,173,034 | 10/1979 | Shemitz . | |
| 4,300,185 | 11/1981 | Wakamatsu . | |
| 4,351,017 | 9/1982 | Ball | 362/33 |
| 4,388,676 | 6/1983 | Sato et al. | 362/33 |
| 4,449,170 | 5/1984 | Warshawsky | 362/414 |

FOREIGN PATENT DOCUMENTS 155678 12/1979 Japan .

*Primary Examiner*—Craig R. Feinberg
*Assistant Examiner*—David A. Okonsky

[57] ABSTRACT

A freestanding luminaire includes a floor-supported frame having a base adapted to rest on the floor, an overhead beam arrangement and an upright member connected at its lower end to the base and at its upper end to the beam arrangement so as to support it in a cantilevered fashion over a work surface. The beam arrangement includes a central longitudinally extending beam and a plurality of cross beams attached to the central beam at spaced locations therealong and extending in transverse relationship to the longitudinal extent of the central beam. The central beam is attached at one end to the upper end of the upright member of the frame and extends in transverse relationship outwardly therefrom. The luminaire also includes a plurality of lamps being preferably of the type which use fluorescent tubes, mounted to and extending between the cross beams. Further, the luminaire has a light enclosure formed by a plurality of interconnected wall members which are attached about the central and cross beams to define a housing encompassing the beams and the lamps mounted thereto and having upper and lower openings therein. A pair of lens plates are disposed in the housing across the openings. In such manner, the overhead beams, the lamps and the light enclosure together integrally define a cantilevered light fixture which directs the light produced by the lamps upwardly toward the ceiling and downwardly toward the work surface.

13 Claims, 7 Drawing Figures

FREESTANDING LUMINAIRE HAVING FLOOR-SUPPORTED FRAME INTEGRATED WITH LIGHT FIXTURE

BACKGROUND OF THE INVENTION

1. Field of the Invention

The present invention relates generally to lighting systems and, more particularly, is concerned with a freestanding luminaire having a floor-supported frame adapted to be placed at a side of a work station in an open plan office and which is integrated with a plurality of lamps and a light enclosure so as to form a light fixture supported in cantilevered fashion over the work station.

2. Background of the Prior Art

Many modern offices and workplaces employ lighting systems which do much more than provide adequate illumination. They provide adequate illumination with the least possible consumption of energy. For a lighting system to be economical it must maximize the use of the most efficient lamps installed in luminaires capable of confortably, effectively, and with good appearance directing a high percent of the lamp light to the points or area where it is needed. Further, the lighting system must be able to do this with very little maintenance cost. In some systems the maintenance cost of cleaning luminaires and replacing worn-out lamps is excessive. The problem of selecting and designing a lighting system that will effectively meet all of these requirements is a difficult problem.

Heretofore, lighting systems have used an endless variety of patterns for arranging lighting fixtures in a room. In selection and design of a lighting system, the location of the luminaire, or location of the people in the room relative to the luminaire, is exceedingly important in establishing satisfactory conditions of visual comfort and in minimizing ceiling reflections.

Recent lighting system designs, especially in open plan offices, have been quite effective in employing the so-called task-ambient principle, in which a fairly low level of general illumination is provided from the ceiling with localized task lighting being provided at the specific location where the task is being performed. Task-ambient lighting can result in very good visibility with low power consumption. In a drafting room, for example, the task lighting may consist of fluorescent or incandescent fixtures mounted on drafting boards, or on chains suspended a few feet above board level.

Many different luminaires appear in the prior art for providing localized task lighting. Representative of the prior art are the luminaires disclosed in U.S. Pat. Nos. to Jarrett et al (2,553,094), Neumann (3,341,702), Horan (3,356,841), Thornton (3,535,509), Shemitz (4,173,034), Wakamatsu (4,300,185) and Sato et al (4,388,676); in Japanese Pat. No. 54-155678; and in a brochure by Keene Lighting Products advertising the Deskmaster lighting system.

While many of these luminaires of the prior art would appear to operate reasonably well and generally achieve their objectives under the range of operating conditions for which they were designed, a need still exists for a fresh approach to luminaire design for task-ambient lighting in the open plan office. Such approach should make installation of the luminaire easier, maximize visual comfort for users, improve its structural integrity and provide more flexibility in its use while minimizing the cost of cleaning and maintaining it.

SUMMARY OF THE INVENTION

The present invention provides a luminaire designed to satisfy the aforementioned needs. The luminaire of the present invention is freestanding and relatively easily moved about. It has a floor-supported frame and a light fixture integrated with the frame and cantilevered over the work station. Its freestanding, floor-supported frame makes the luminaire easy to place in any of a variety of positions which may be desired by different users. Integration of the frame and light fixture of the luminaire enhances its structural integrity and prolongs its useful life. The illumination produced by the luminaire is visually comfortable to the user in that while providing direct light downwardly from the light fixture over the work surface, it also provides ambient light upwardly above the light fixture for indirect illumination of the general space in which the work surface is located. In such manner, the luminaire of the present invention also eliminates the necessity of ceiling mounted fixtures for general room illumination. Furthermore, the freestanding frame permits more freedom in placement of other furniture needed in the general work space and provides less visual obstruction across the space. The openness of its integrated frame and light fixture enhances it cleanability and maintainability.

Accordingly, the present invention is directed to a freestanding luminaire comprising: (a) a floor-supported frame including an overhead beam arrangement supported in a cantilivered fashion; (b) lighting means including at least one lamp mounted to the beam arrangement; and (c) a light enclosure attached to the overhead beam arrangement and surrounding the arrangement and the lamp mounted thereto so as to define a light fixture which directs the light produced by the lamp upwardly and downwardly therefrom.

More particularly, the floor-supported frame further includes a base adapted to rest on the floor and an upright member, composed of a pair of inner and outer posts which telescope with one another, extending between and interconnecting the base and overhead beam arrangement. The overhead beam arrangement includes a central longitudinally extending beam attached at one end to the upright member and extending in transverse relation outwardly therefrom, and a plurality of cross beams attached to the central beam at spaced locations therealong so as to extend in transverse relation to the longitudinal extent of the central beam.

The light enclosure includes a plurality of interconnected wall members attached about the central and cross beams of the overhead beam arrangement so as to define a housing encompassing the beams and having upper and lower openings therein. Also, the enclosure has a pair of upper and lower light-transmitting lens plates mounted in spaced relationship within the housing across the upper and lower openings thereof. The lighting means preferably includes a plurality of lamps mounted to and extending between the cross beams so as to be disposed within the enclosure between the upper and lower lens plates thereof. The lamps preferably include fluorescent tubes.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
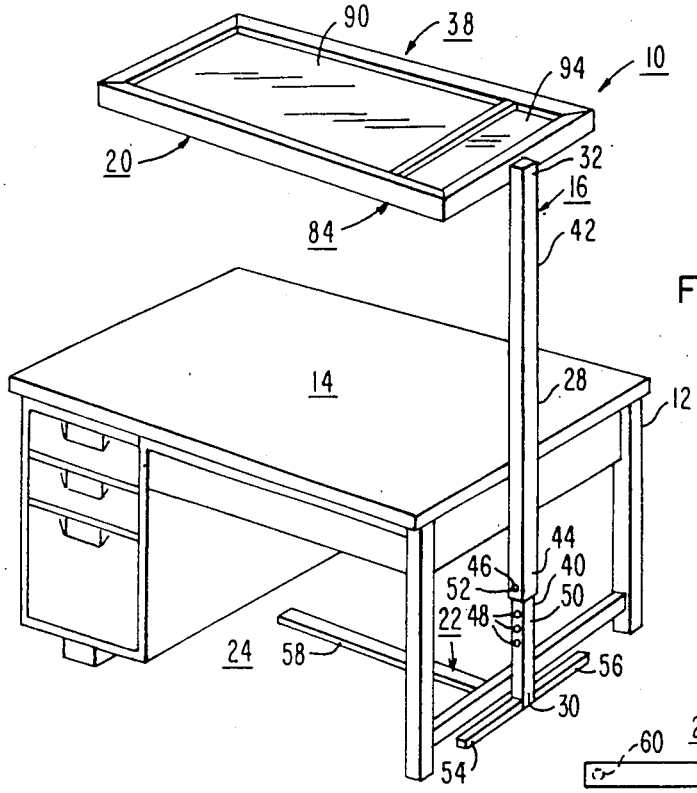
FIG. 1 is a perspective view of a conventional desk together with the freestanding luminaire of the present invention with its floor-supported frame positioned along a side of the desk and supporting in cantilivered fashion an integral light fixture over a work surface provided by the desk.

In the following description, like reference characters designate like or corresponding parts throughout the several views of the drawings. Also in the following description, it is to be understood that such terms as "forward", "rearward", "left", "right", "upwardly", "downwardly", and the like are words of convenience and are not to be construed as limiting terms.

Referring now to the drawings, and particularly to FIG. 1, there is shown the preferred embodiment of the freestanding luminaire of the present invention being indicated generally by the numeral 10. The luminaire 10, when positioned beside a conventional office desk 12 as seen in FIG. 1, functions advantageously to illuminate both the work surface 14 of the desk 12 directly and the surrounding space indirectly in accordance with the task-ambient lighting principle described earlier herein.

The freestanding luminaire 10 broadly includes a floor-supported frame, generally designated 16, lighting means 18 (FIG. 5) and a light enclosure 20. The frame 16 has a base 22 adapted to rest on the floor 24 which also supports the desk 12. Additionally, the frame 16 includes an overhead beam arrangement 26 (FIG. 5) and an upright member 28 connected at its lower end 30 to the base 22 and at its upper end 32 to the beam arrangement 26 so as to support it in a cantilivered fashion above and over the work surface 14 of the desk 12. In such interconnected arrangement, the base 22 and upright member 28 together with the overhead beam arrangement 26 provide the floor-supported frame 16 in a generally square or block C-shaped configuration. The lighting means 18 of the freestanding luminaire 10 is mounted to the beam arrangement 26 such that the light enclosure 20 which is attached to the overhead beam arrangement 26 surrounds it and the lighting means 18. The light enclosure 20 also has upper and lower openings 34,36 (FIGS. 6 and 7) such that it together with the overhead beam arrangement 26 and the lighting means 18 integrally define a light fixture, generally indicated at 38, which directs the light produced by the lighting means 18 in both upwardly and downwardly directions.

Figure 3:
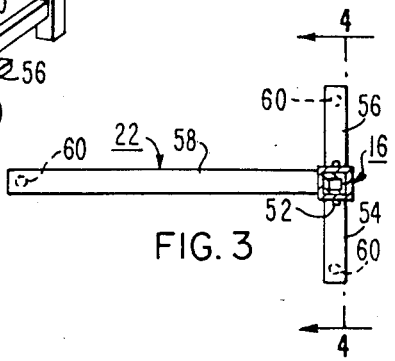
FIG. 3 is a top plan view of the base of the freestanding frame of the luminaire as seen along line 3—3 of FIG. 2, with the upright member being shown in cross section.
Figure 2:
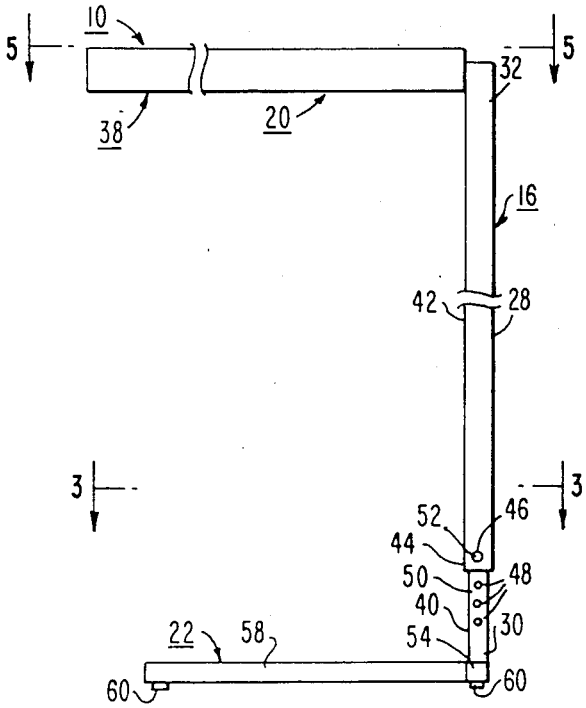
FIG. 2 is a side elevational view of the freestanding luminaire with its integral light fixture and the upright member of its frame both being shown in respective horizontally and vertically foreshortened form.
Figure 4:
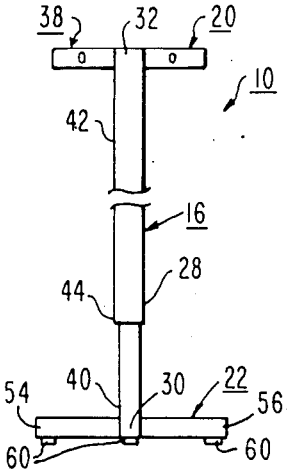
FIG. 4 is an end elevational view, in partly vertically foreshortened form, of the freestanding luminaire as seen along line 4—4 of FIG. 3.

As seen in FIG. 1, and also depicted in FIGS. 2–4, the upright member 28 of the floor-supported frame 16 is composed of a pair of inner and outer tubular posts 40,42 which telescope with one another. Each of the posts 40,42 is preferably of metal tubular construction, such as steel tubes having a generally square cross-sectional configuration. The outside dimensions of the inner post 40 are respectively sized relative to the inside dimensions of the outer post 42 to allow the inner post 40 to be slidably inserted into the outer post 42 at its lower end 44. In such manner, a close fitting, telescoping relationship is established between the posts 40,42 such that by sliding one post relative to the other post, the overall length of the upright member 28 (and thereby the height of the freestanding luminaire 10) can be changed. The posts 40,42 can be adjustably connected together in a fixed relationship relative to one another to preset or establish a desired height for the luminaire 10 by, first, moving the posts relative to one another to align a single pair of aligned holes 46 (only one hole of the pair being shown) formed through the lower end 44 of the outer post 42 with an appropriate one pair of aligned holes 48 (only one hole in each pair being shown) in a series of spaced pairs thereof formed through the lower position 50 of the inner post 40 and, then, inserting a pin 52 through the aligned pairs of holes 46,48.

The base 22 of the floor-supported frame 16 has a T-shaped configuration formed by a pair of short fore-and-aft legs 54,56 and a long transverse leg 58. All of the legs 54,56,58 preferably of metal tubular construction, such as steel tubes having a generally rectangular cross-sectional configuration, are rigidly connected together and to the lower end 30 of the upright member 28 (which is also the lower end of the inner post 40) in any suitable manner, such as by welding, at their intersection with one another. A cylindrical pedestal 60 is attached to the underside of the outer terminal end of each of the legs 54,56,58. Thus, the weight of the luminaire 10 is supported on the floor 24 at the spaced locations of the three pedestals 60, as clearly seen in dashed outline form in FIG. 3. It should be understood that more than three pedestals could be used.

Figure 5:
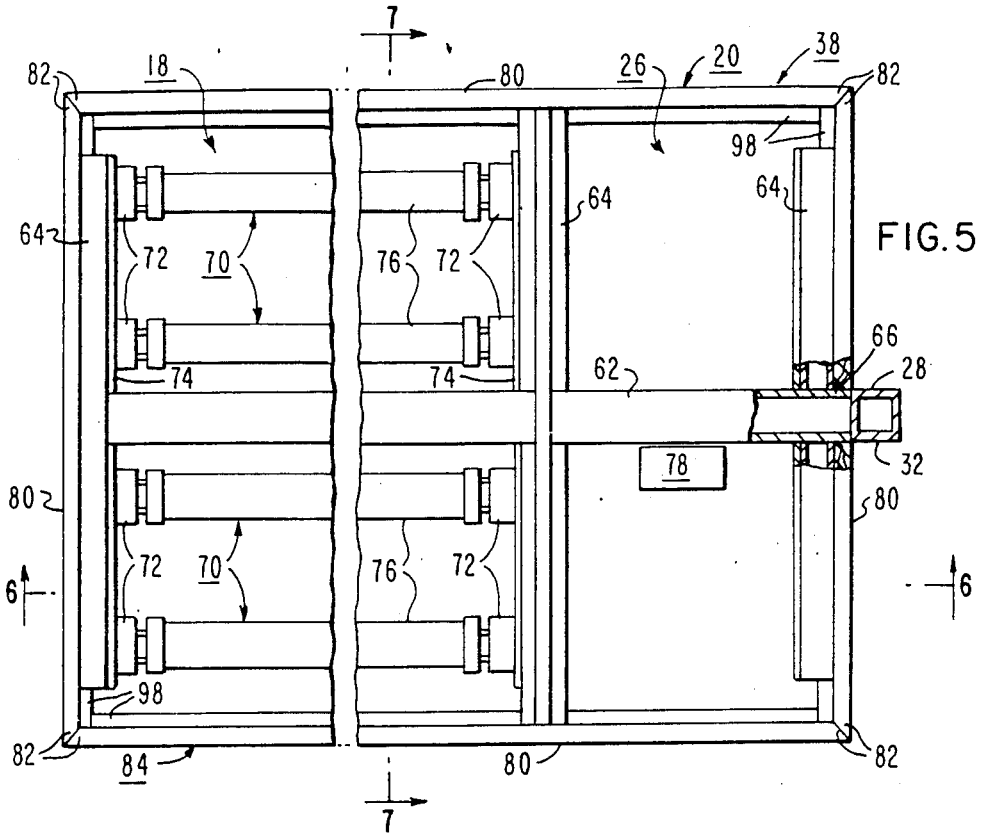
FIG. 5 is an enlarged top plan view, partly in section, of the integral light fixture of the luminaire as seen along line 5—5 of FIG. 2.
Figure 6:
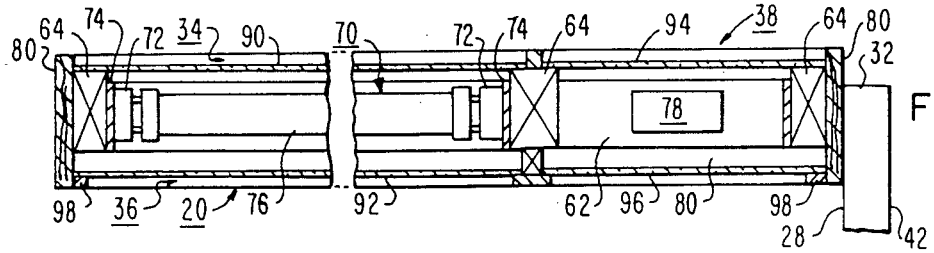
FIG. 6 is a sectional view of the integral light fixture of the luminaire as seen along line 6—6 of FIG. 5.
Figure 7:
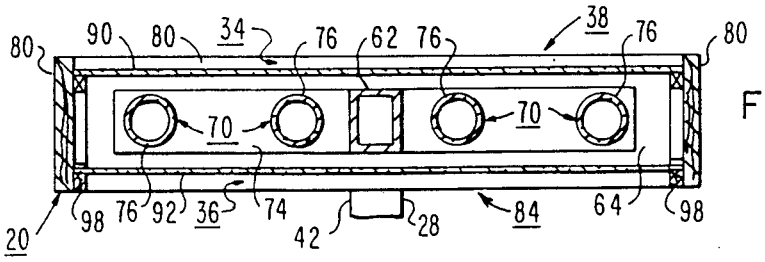
FIG. 7 is another sectional view of the integral light fixture of the luminaire as seen along line 7—7 of FIG. 5.

Turning now to FIGS. 5–7, there is shown the details of the overhead beam arrangement 26 of the floor-supported frame 16 as well as of the lighting means 18 and the light enclosure 20. The overhead beam arrangement 26 includes a central longitudinally extending beam 62 and a plurality of cross beams 64, each being preferably of metal tubular construction, such as steel tubes having a generally square cross-sectional configuration. The central beam 62 is attached at its inner end 66 to the upper end 32 of the upright member 28 (which is also the upper end of the outer post 42) in any suitable manner, such as by welding. The several cross beams 64 of the arrangement 26 are attached to the central beam 62 at spaced locations therealong between its inner end 66 and an outer end 68 thereof so as to extend in a transverse relationship to the longitudinal extent of the central beam 62 and in parallel relationship to one another.

The lighting means 18 preferably includes a plurality of lamps 70 mounted to and extending between a spaced pair of the cross beams 64 in transverse relationship thereto and in generally parallel relationship to one another and to the central beam 62 of the beam arrangement 26. In the illustrated embodiment, two lamps 70 are disposed between the cross beam pair on each opposite side of the central beam 62. The lamps 70 include sockets 72 mounted on plates 74 which are, in turn, attached to facing sides of the cross beams 64 and a light-producing device such as a fluorescent tube 76 operatively mounted within and extending between each of the several opposing pairs of the sockets 72. A ballast 78 electrically wired in circuit with the sockets 72 in a known manner for operating the fluorescent tubes 76 is attached to the central beam 62.

The light enclosure 20 of the freestanding luminaire 10 is formed of a plurality of interconnected wall members 80, being preferably four in number and composed of a suitable wood material. The wall members 80 are attached to one another at their respective opposite vertical edges 82 and to the cross beams 64 by any suitable means such as conventional fasteners or adhesives so as to form a housing, generally designated 84, which surrounds the beam arrangement 26 and the plurality of lamps 70 mounted thereto. As seen in FIG. 5, the housing 84 has upper and lower openings 34,36 through which light produced by the lamps 70 is directed both upwardly and downwardly therefrom.

Further, as seen in FIGS. 6 and 7, the light enclosure 20 has a pair of upper and lower light-transmitting means, preferably in the form of a pair of upper and lower plastic lens plates 90,92 which are mounted in spaced relationship within the housing 84 across its upper and lower openings 34,36 above and below the lamps 70. The remainder of the openings 34,36 of the housing 84 which lead to an interior portion of the housing in which the ballast 78 is located are covered by a pair of upper and lower opaque plates 94,96. The upper plates 90,94 seat on the top surfaces of the central and cross beams 62,64, while the lower plates 92,96 seat on the top of ledges 98 attached to the inside of the lower edge portions of the interconnected wall members 80. The upper plates 90,94 can readily be removed from the housing 84 by lifting them through the upper opening 86, However, slots (not shown) aligned with the top of the ledges 98 are formed in one of the wall members 80 through which to insert and withdraw the lower plates 92,96 into and from the housing 84. When the plates 90–96 are removed, the interior of the housing 84 is readily accessible for cleaning and maintenance purposes through both the upper and lower openings 34,36 thereof.

It is thought that the freestanding luminaire of the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

I claim:

1. A freestanding luminaire, comprising:

(a) a floor-supported frame including an overhead beam arrangement supported in a cantilevered fashion;

(b) lighting means including at least one lamp mounted to said beam arrangement; and (c) a light enclosure attached to said overhead beam arrangement and surrounding said beam arrangement and said lamp mounted to said beam arrangement so as to define a light fixture which directs the light produced by said lamp upwardly and downwardly therefrom;

(d) said overhead beam arrangement including a central longitudinally extending beam, and a plurality of cross beams attached to said central beam at spaced locations therealong so as to extend in transverse relationship to the longitudinal extent of said central beam and to support said at least one lamp therebetween.

2. The freestanding luminaire as recited in claim 1, wherein said light enclosure includes:

a plurality of interconnected wall members attached about said central and cross beams so as to define a housing encompassing said beams and having upper and lower openings therein; and a pair of upper and lower light-transmitting lens plates mounted in spaced relationship within said housing across said upper and lower openings thereof.

3. The freestanding luminaire as recited in claim 2, wherein said lighting means further includes:

a plurality of lamps mounted to and extending between said cross beams so as to be disposed within said enclosure between said upper and lower lens plates thereof.

4. The freestanding luminaire as recited in claim 3, wherein said lamps include fluorescent tubes.

5. The freestanding luminaire as recited in claim 1, wherein said floor-supported frame further includes:

a base adapted to rest on a floor; and an upright member having lower and upper ends, said member extending between and at its respective lower and upper ends interconnecting said base and said overhead beam arrangement.

6. The freestanding luminaire as recited in claim 5, wherein said interconnected base, upright member and overhead beam arrangement of said floor-supported frame have a C-shaped configuration.

7. The freestanding luminaire as recited in claim 5, wherein said base includes:

a plurality of legs connected together in a T-shaped arrangement with said legs being connected to said lower end of said upright member at the intersection of said legs in said arrangement.

8. The freestanding luminaire as recited in claim 5, wherein said upright member includes:

a pair of inner and outer tubular posts which telescope with one another.

9. The freestanding luminaire as recited in claim 8, wherein said upright member further includes:

means for adjustably connecting said posts together so as to preset the length of said upright member.

10. The freestanding luminaire as recited in claim 9, wherein said connecting means includes:

a series of spaced holes defined along one of said posts;

at least one hole defined in a remaining one of said pair of posts and alignable with at least one of said spaced holes in said one post; and a pin insertable through at least one of said spaced holes in said one post and said one hole in said remaining post for securing said posts together in a fixed relationship.

11. A freestanding luminaire, comprising:

(a) a floor-supported frame including (i) a base adapted to rest on a floor;

(ii) an overhead beam arrangement, and (iii) an upright member having lower and upper ends, said upright member extending between and being connected at its upper end to said overhead beam arrangement so as to support said arrangement in a cantilevered fashion;

(b) lighting means mounted to said overhead beam arrangement and including at least one lamp; and (c) a light enclosure including (i) a plurality of interconnected wall members attached to said overhead beam arrangement so as to form a housing surrounding said beam arrangement and said lighting means and having upper and lower openings therein so as to define a light fixture which directs the light produced by said lighting means upwardly and downwardly therefrom, and (ii) a pair of upper and lower light-transmitting means mounted in spaced relationship within said housing across said upper and lower openings thereof;

(d) said overhead beam arrangement including (i) a central longitudinally extending beam attached at one end to said upper end of said upright member and extending in transverse relation outwardly therefrom, and (ii) a plurality of cross beams attached to said central beam at spaced locations therealong so as to extend in transverse relationship to the longitudinal extent of said central beam and to support said at least one lamp therebetween.

12. The freestanding luminaire as recited in claim 11, wherein said lighting means includes:

a plurality of lamps mounted to and extending between said cross beams so as to be disposed within said enclosure between said upper and lower light-transmitting means thereof.

13. The freestanding luminaire as recited in claim 11, wherein said upright member includes:

a pair of inner and outer tubular posts which telescope with one another.

* * * * *